United States Patent [19]

Cowgill

[11] 4,075,715

[45] Feb. 28, 1978

[54] HELMET HAVING ANTI-LIFT DEVICE

[75] Inventor: Duane W. Cowgill, Altadena, Calif.

[73] Assignee: Sierra Engineering Co., Sierra Madre, Calif.

[21] Appl. No.: 742,006

[22] Filed: Nov. 15, 1976

[51] Int. Cl.[2] ..... A42B 3/00

[52] U.S. Cl. ..... 2/6; 2/421

[58] Field of Search ..... 2/421, 6

[56] References Cited

U.S. PATENT DOCUMENTS

| | | | |
|---|---|---|---|
| 3,423,759 | 1/1969 | Catroppa et al. | 2/6 |
| 3,548,410 | 12/1970 | Parker | 2/10 X |
| 3,721,994 | 3/1973 | DeSimone et al. | 2/6 |
| 3,927,421 | 12/1975 | Simon | 2/12 |

*Primary Examiner*—Alfred R. Guest

*Attorney, Agent, or Firm*—D. Gordon Angus; Donald D. Mon

[57] ABSTRACT

A helmet useful for crew members of an aircraft from which they may be ejected at high speeds comprises a shell over which there is a visor housing containing a visor which can be pulled down over the face of the searer. An anti-lift device in the form of a flange protrudes from the visor housing and extends from a position near a forward side edge of the visor housing and passes around and across the top crown area to a position near the opposite forward side edge of the visor housing. The flange rises from a lowest elevation near the forward side edges to a highest elevation at the top crown area. The regions adjacent the forward side edges constitute wings at a negative angle of attack against wind blase and the region in the vicinity of the top crown area constitutes a spoiler producing turbulence to spoil upward lift.

4 Claims, 19 Drawing Figures

4A
51
3
50
10
39
40
21
42
43
19
20
17
18
24a
41
11
23
44
110
111
27
25
29
30
26
28
30a
36
31

40
6
50
51
18
94a
47
41
46
47a
11a
11
10
13
12
4

132
39
131a
37
130
38

16
11a
11
12
13
24
24a
29
32
31
30
25
27
15
34
24b
14

58
59
60
62a
51
61
64
62b
70
54
76
70c
74
71
53
70e
67
66
78
76
73
72
79
71a
70a
52a
75
52b
52c
52
57
83
56
56a

HELMET HAVING ANTI-LIFT DEVICE

This invention relates to protective helmets and more particularly to helmets worn in aircraft during flight and during ejection from aircraft during flight, and the like.

Helmets are commonly worn on the heads of occupants of aircraft, especially military aircraft, for protection against injury to the person. Such helmets are commonly retained on the head by a retention strap system to prevent disengagement from the head while in use both in the aircraft and during ejections. A helmet is commonly provided with a transparent visor for positioning in front of the eyes of the wearer, and with a face mask which can supply oxygen to the person, and with an earphone arrangement for communication purposes.

When a person is ejected from an aircraft his helmet is subjected to high stresses which have resulted in injury to the person and in a substantial rate of loss of helmets during the ejection period. Recent statistics have indicated an average helmet loss rate of about 16% of persons ejected. Hence about 16% of person ejected have had to go through their ejection mode without the protection of a helmet.

It has been determined that the mechanics of the helmet loss during ejection are a lifting action relative to the head, followed by a forward rotation on the head resulting in failure of the helmet strap to retain the helmet on the head. It has been calculated that the average helmet heretofore used is subject to a lifting force for about 450 pounds at an airspeed of 600 knots. This lift is due to the fact that the helmet with its visor housing basically acts as an air foil. It is known that a smooth flow of air over the surface of an air foil generates lift. It is also known that such lift can be removed or minimized by abruptly detaching the smooth air flow over the surface of the visor housing which is acting as an air foil, thereby producing a stall effect at an air foil.

The invention is carried out by provision of a shell to fit over the head of the wearer, having flat areas at the ears and downwardly depending areas at the sides of the face in front of the ears, inclined toward the flat areas. The visor is arranged to retract within a visor housing placed over the forward crown part of the shell and having sideburns which come down over the side face areas to merge into the same planes with the flat areas of the shell.

A unique feature of the visor housing resides in the provision of an anti-lift device at the upper surface of the visor housing. This anti-lift device is in the form of a flange outstanding from the visor housing, extending from a position near the forward edge of the visor housing and passing around the top crown area to the forward edge at the opposite side of the visor housing.

A feature of this anti-lift device resides in the formation of its leading edges as wings at a negative angle of attack, thus producing negative lift; and the formation of the upper rearward portion has an upstanding spoiler to spoil lift.

The unique blending of the leading edges with the rearward spoiler assures boundary separation at the peak of the helmet.

An object of the present invention is to provide a helmet characterized by relatively low lifting force during egress from a moving aircraft.

The foregoing and other features of the invention will be better understood from the following detailed description and the accompanying drawings of which:

Figure 1:
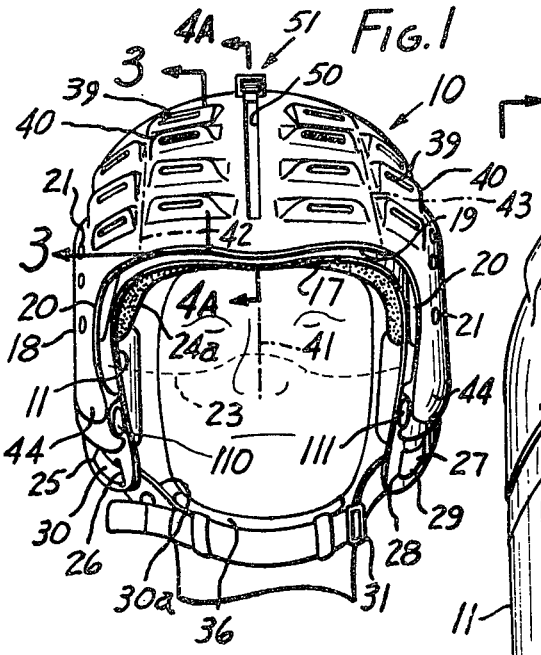
FIG. 1 is a front view of a helmet containing parts used in a helmet according to this invention.
Figure 3A:
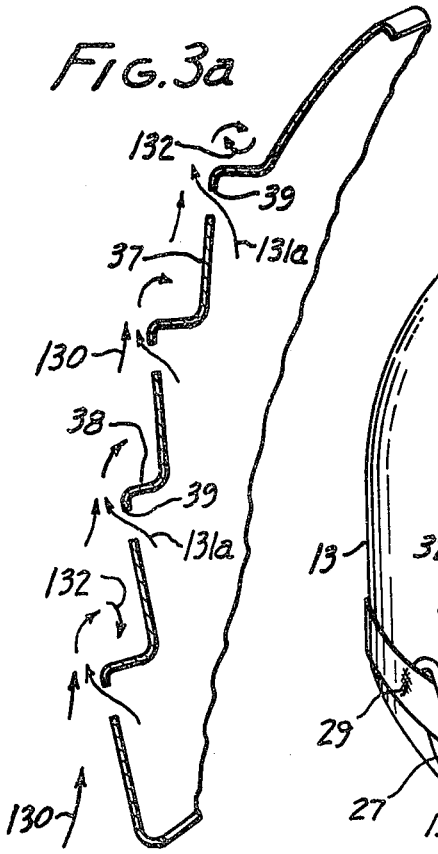
Figure 3B:
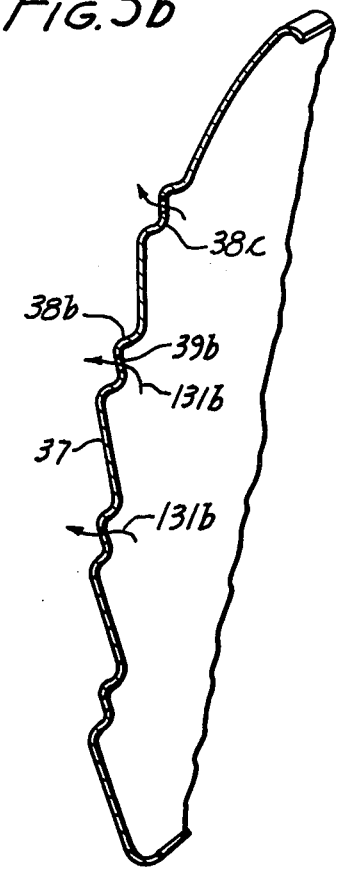

FIG. 3*a* is a cross-section view showing a detail of the louvered visor housing of the helmet taken at line 3—3 of FIG. 1;

FIG. 3*b* is a cross-section view showing a construction which differs from that of FIG. 3a in the positions of the louvers of the visor housing, this construction being usable alternatively to that of FIG. 3*a;*

Figure 3C:
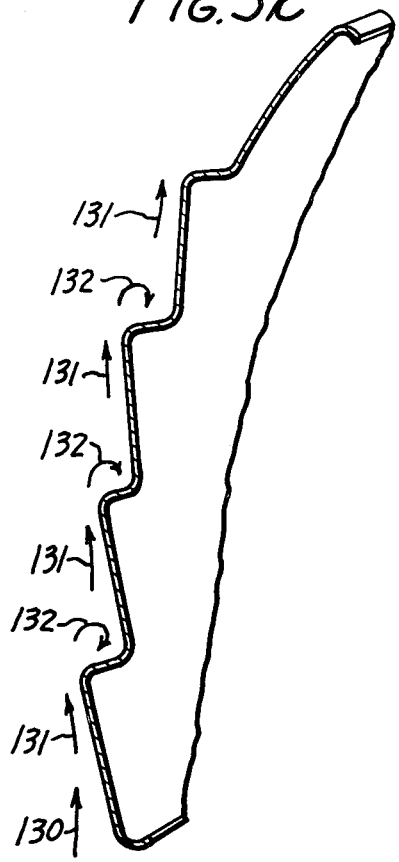

FIG. 3*c* is a cross-section view showing a construction which differs from those of FIGS. 3*a* and 3*b* in having no louvers opening in the visor housing, this construction being usable alternatively to those of FIGS. 3*a* and 3*b;*

Figure 2:
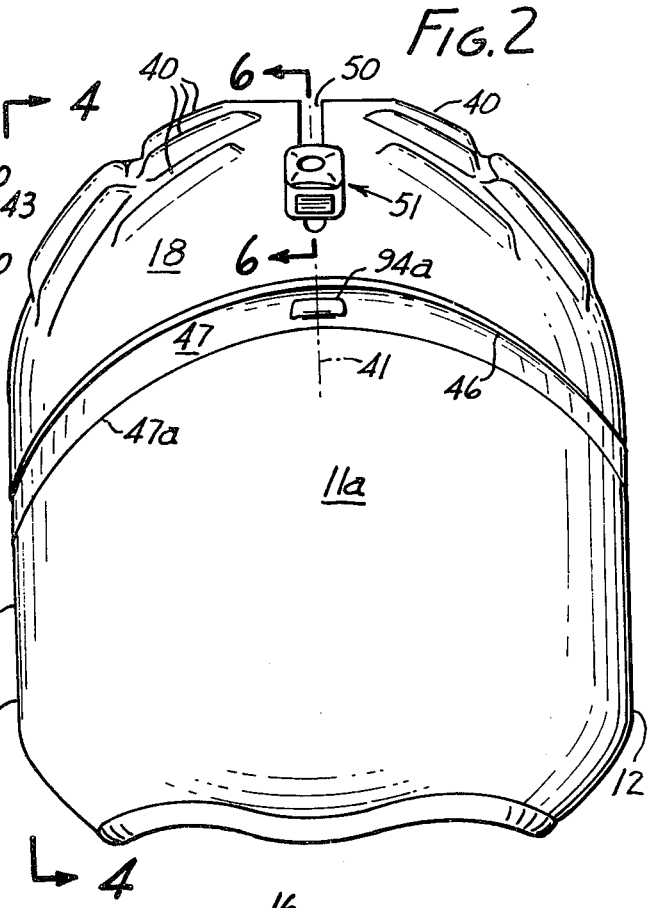
FIG. 2 is a top view, looking from the rear, of the helmet of FIG. 1 drawn on a larger scale than in FIG. 1.
Figure 5:
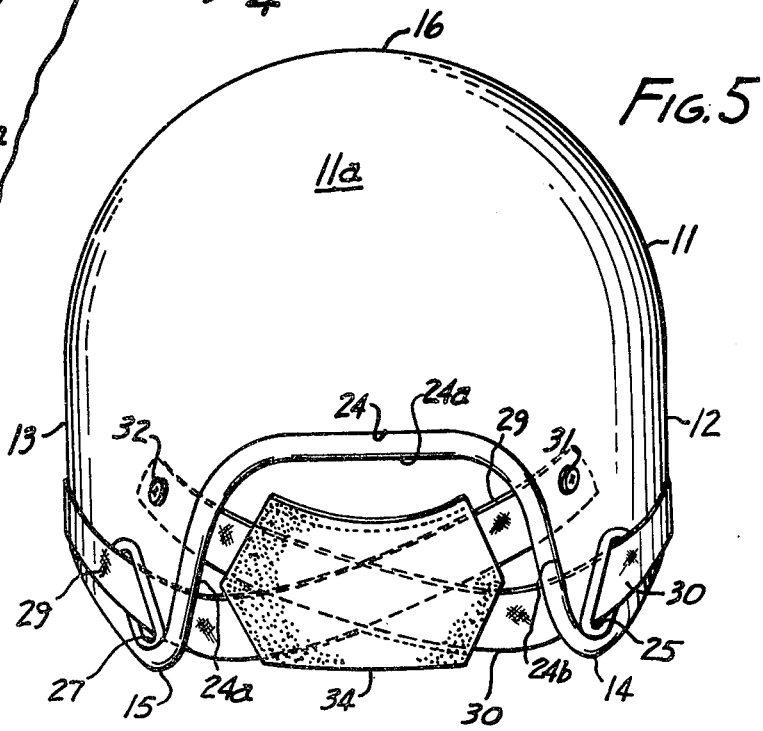
Figure 15:
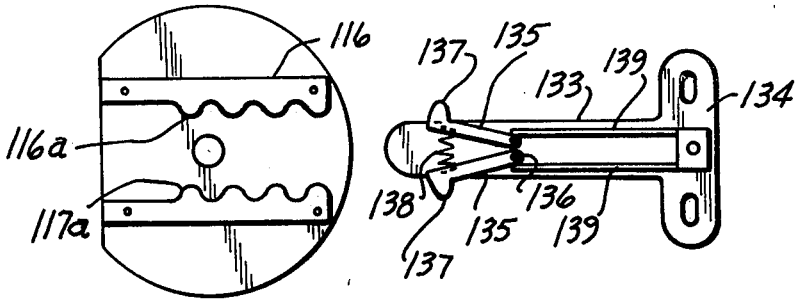
Figure 4:
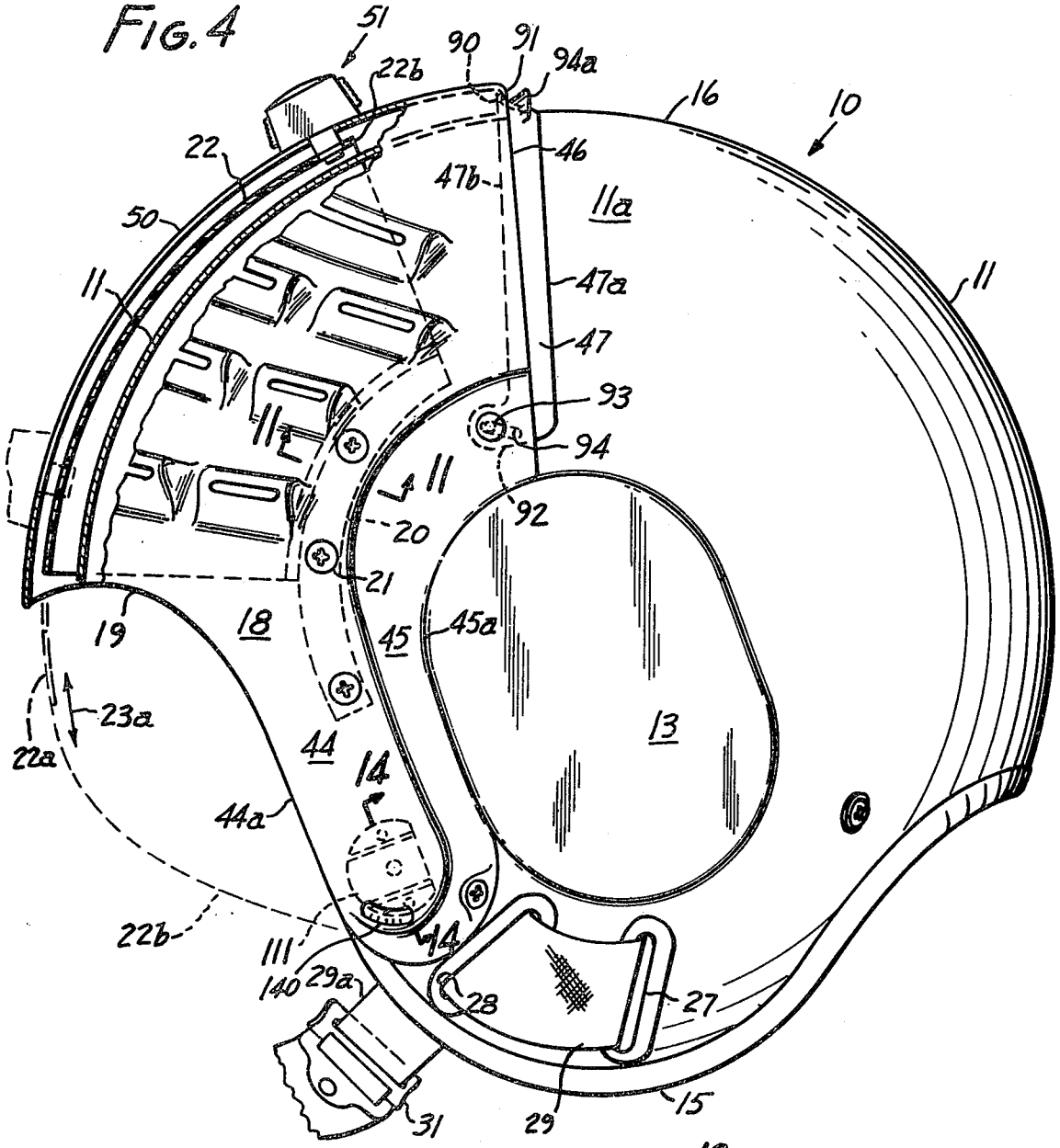
Figure 13:
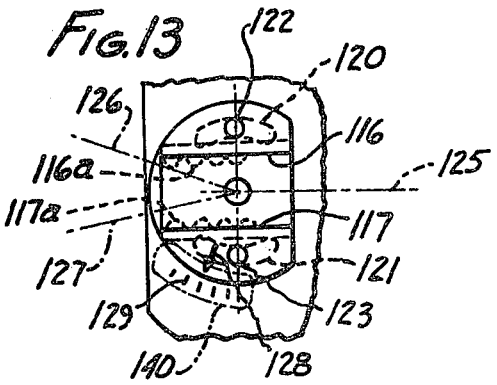
Figure 14:
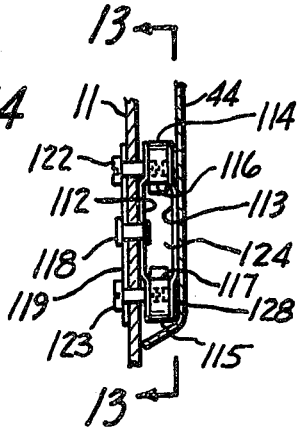
Figure 6:
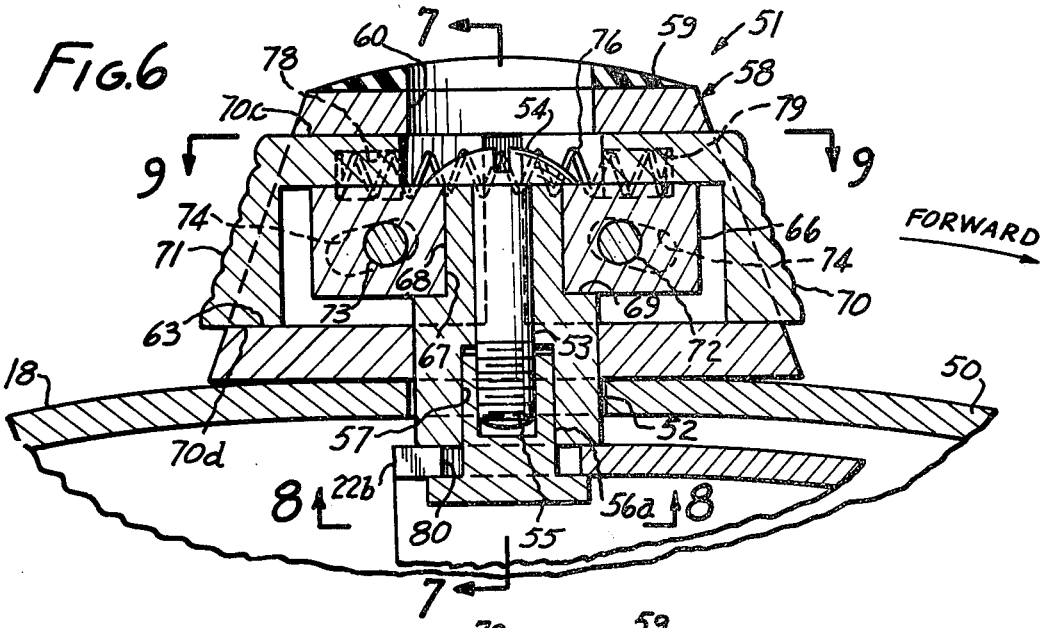
Figure 7:
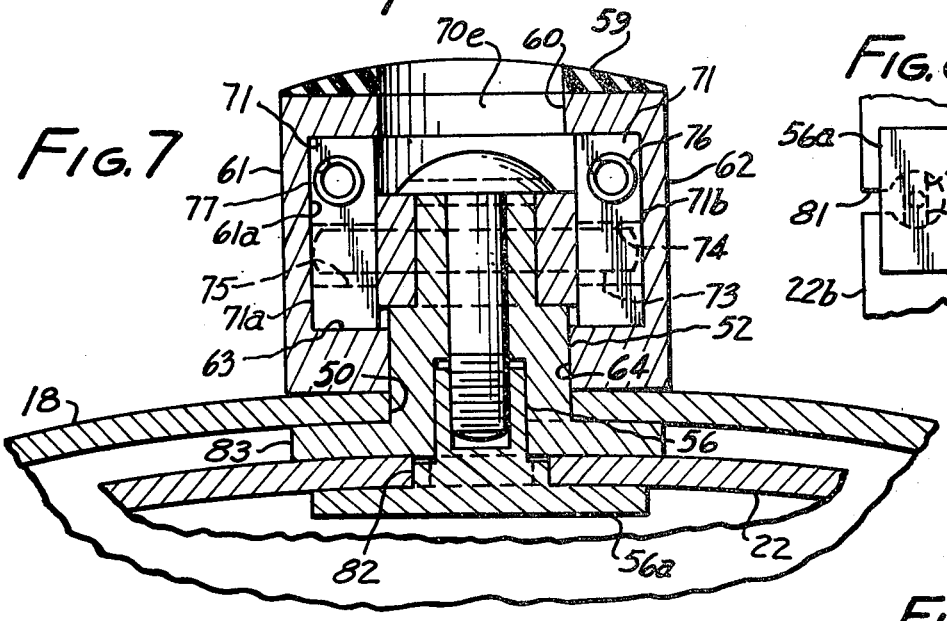
Figure 8:
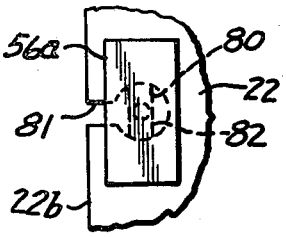
Figure 9:
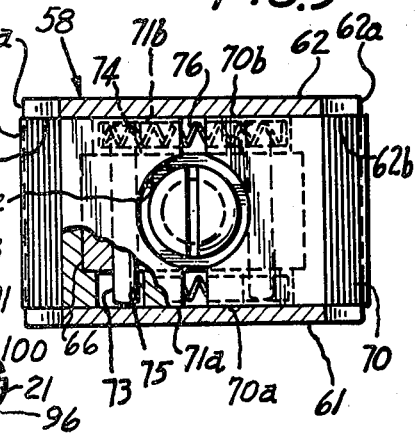
Figure 12:
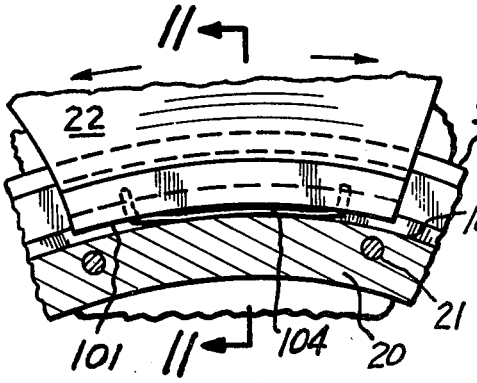
Figure 11:
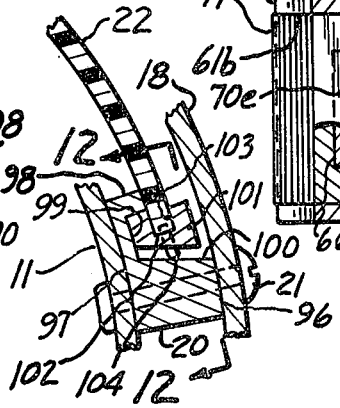
Figure 10:
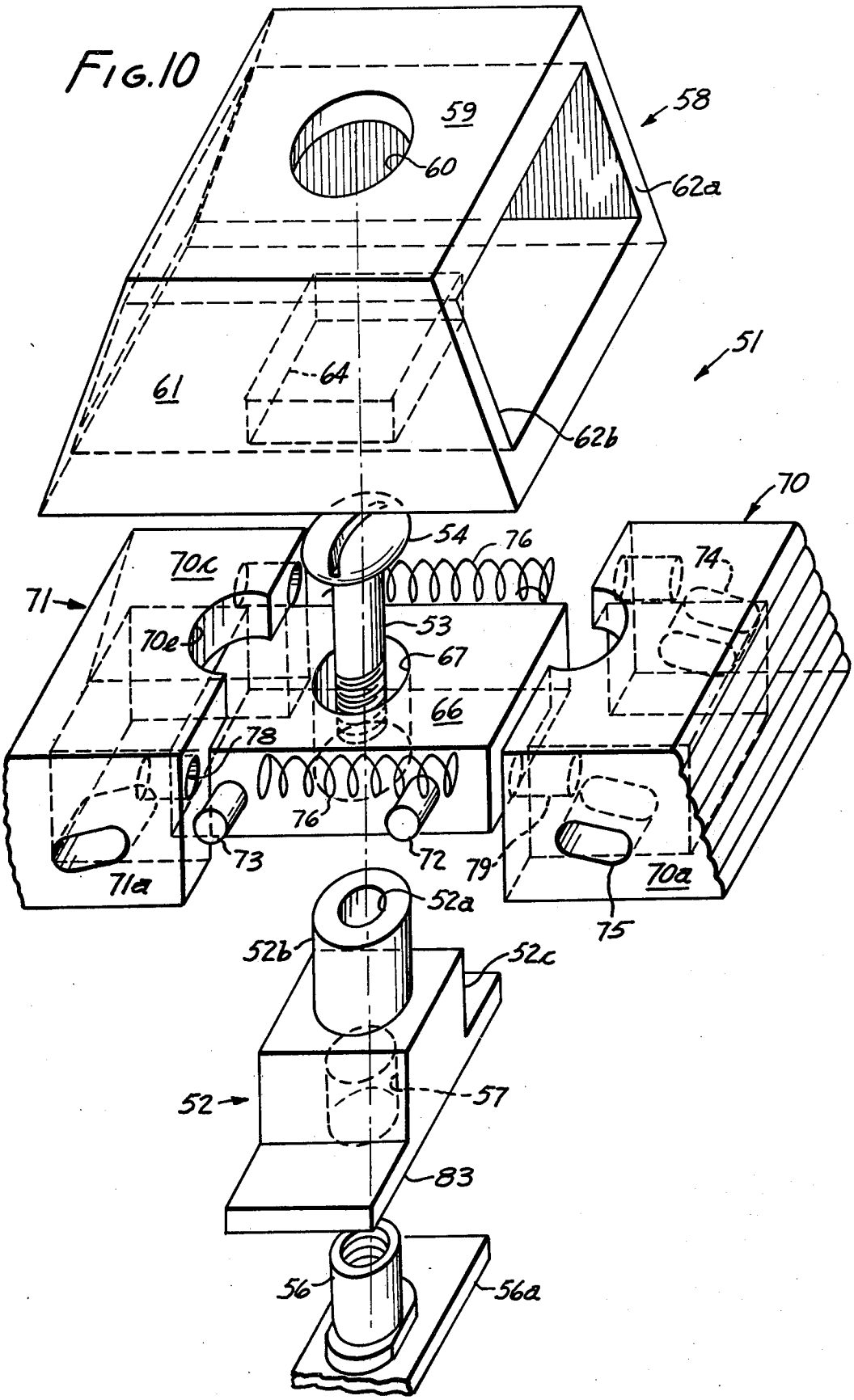
Figure 16:
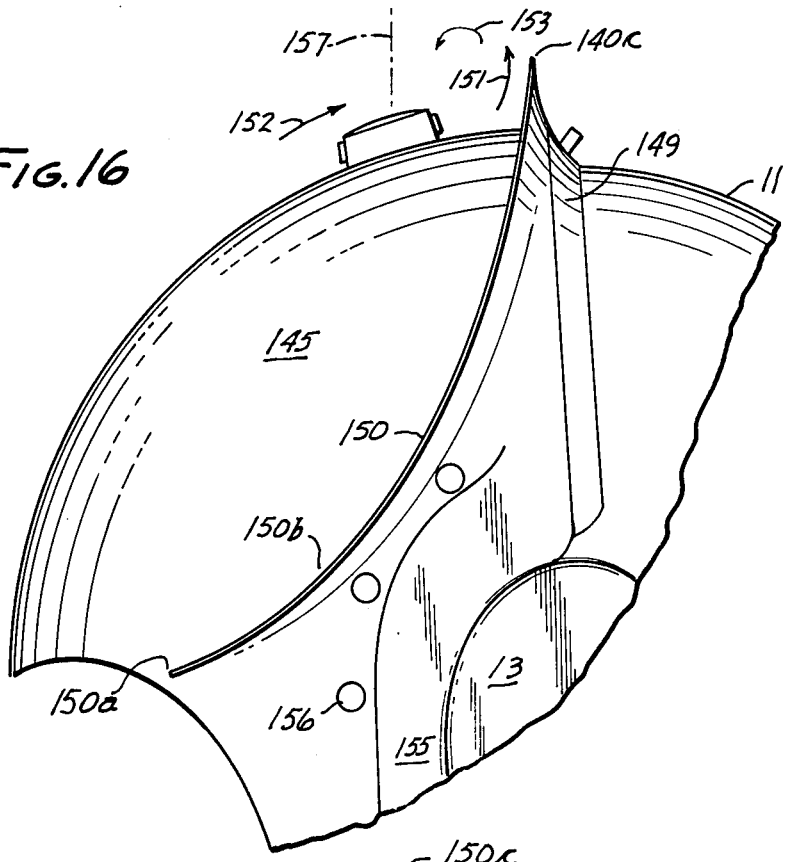
Figure 17:
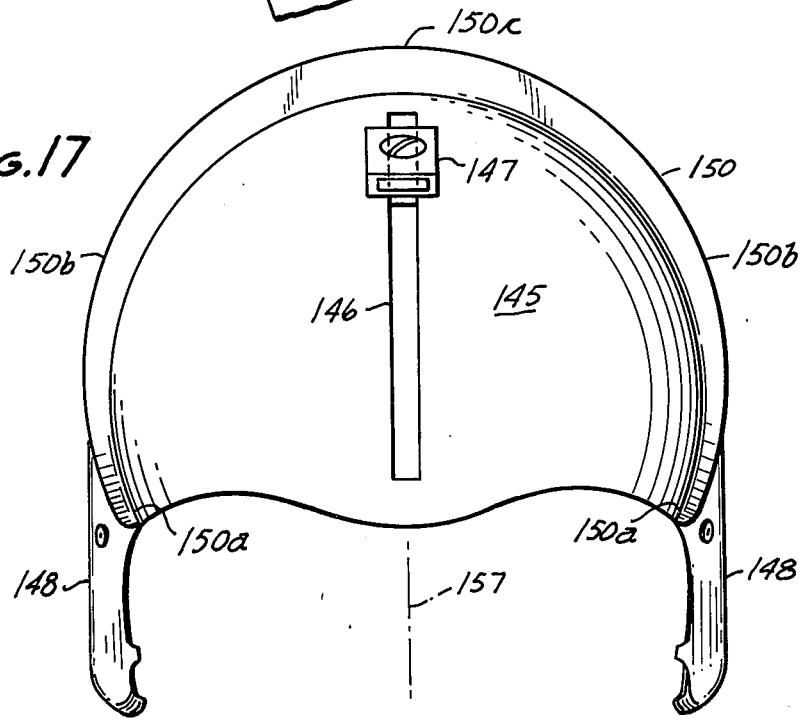

FIG. 4 is a side view of the helmet of FIGS. 1 and 2, looking from line 4—4 of FIG. 2;

FIG. 5 is a rear view of the helmet viewed from a position lower than that from which FIG. 2 is viewed;

FIG. 6 is a view partially in cross-section, showing a visor lock of the helmet, looking from line 6—6 of FIG. 2;

FIG. 7 is a view partially in cross-section, looking from line 7—7 of FIG. 6;

FIG. 8 is a view of detail looking from line 8—8 of FIG. 6;

FIG. 9 is a view partially in cross-section, showing a detail from line 9—9 of FIG. 6;

FIG. 10 is an exploded view of elements embodied in the visor lock of FIGS. 6 through 9;

FIG. 11 is a view partially in cross-section, showing a detail of a visor attachment and track, looking from line 11—11 of FIG. 4, and also from line 11—11 of FIG. 12;

FIG. 12 is a cross-section view showing a detail looking from line 12—12 of FIG. 11;

FIG. 13 is a face view showing a bayonet receiver for a face mask, looking from line 13—13 of FIG. 14;

FIG. 14 is a cross-section view of the bayonet receiver mounted on the helmet shell, taken at line 14—14 of FIG. 4;

FIG. 15 illustrates the relationship of the bayonet receiver and a bayonet adapted to enter it;

FIG. 16 is a partial view from the side, of a helmet according to this invention embodying all the parts in the helmet of FIG. 1, except that the visor housing is different from that of FIG. 1; and FIG. 17 is a front view of the visor housing of FIG. 16 shown separate from the helmet shell.

The drawings show a helmet 10 comprising a shell 11 having a dome portion 11*a* which when worn covers the top and back of the wearer's head. The shell is brought down at the sides over the ears of the wearer, the right ear portion being at area 12 and the left ear portion being correspondingly located at area 13. For this purpose the right side below the ear has a relatively low peripheral contour 14 and the left side below the ear has a correspondingly low peripheral contour 15 relative to the crown area 16. The front brow line 17 is shown in FIG. 1 and when the helmet is worn the eyes of the wearer will be below the brow line. For the purpose of providing a visor housing and also for added protection to the wearer the helmet is provided with a contoured visor housing element or shield 18 covering the forward crown part of the shell 11 and having a brow line 19 near the brow line 17 of the shell. The shield 18 is spaced somewhat outward of the shell by spacing means 20 and both the spacing means and the shell are fastened to the shell by screws 21 at both sides of the helmet. The spacing means are constructed and arranged to provide visor tracks as is more fully described hereafter.

The visor housing is provided with downwardly extending extensions or "sideburns" 44 at either side of the face of the wearer as best seen in FIG. 1 at the left side of the helmet. These are contoured or slanted inwardly toward the face at the forward edges 44*a*. To the rear of each slanted portion 44 there is a flat area 45 best seen in FIG. 4 which merges with and is substantially co-planar with the flat oval shaped area 13 of the shell.

The helmet is provided with a transparent visor 22, best seen in FIG. 4, located between the foreward crown part of the shell 11 and the shield or housing element 18, and having a curvature substantially corresponding with that of the shell. When fully retracted between the shell and shield, the visor extends across the crown from side to side, and is positioned entirely between the shell and the housing. It is arranged to slide so that its forward edge 23 can be brought down from the housing to a position below the eyes as shown in phantom in FIG. 1. In FIG. 4 the lower part 22*a* of the visor is shown at a position somewhat emerged from the housing. The arrow 23*a* indicates its path of movement in sliding. The dotted line 22b (FIG. 4) indicates the path of the visor in moving to its lowermost position shown in phantom in FIG. 1, where it serves as a shield for the eyes of the wearer. Means for sliding the visor is described hereinafter. The periphery at the lower rear part of the helmet at the area between the ears of the wearer is contoured upwardly at 24, as best seen in FIG. 5, to leave exposed the nape of the neck of the wearer.

The inside of the shell 11 is preferably lined with cushion material 24*a* in a manner common to the art, as can be seen in FIGS. 1 and 4, for the purpose of added comfort and safety of the wearer. Instead of earphones within each side of the helmet such as helmets customerily have, the present helmet is provided with sound-insulated earcups of an elastomeric type, inside the respective areas 12 and 13 to fit over and seal around the ears of the wearer. Acoustic tubing from a transducer at the nape area to each of the earcups will provide communication to the earcups.

At each side of the helmet shell below the ear areas 12 and 13 there is provided a pair of spaced strap guide slots for passage of straps, these comprising a rearward guide slot 25 and a forward guide slot 26 at the right side, and a rearward guide slot 27 and a forward guide slot 28 at the left side. If desired, an intermediate guide slot may be provided between the forward and rearward guide slots. A pair of strap members 29 and 30 is provided for securing the helmet to the head of the wearer. One end of the strap 29 is fastened to the inside of the helmet shell at the right side by suitable fastener means 31. This strap 29 is carried across the open space between the rear peripheral shell edges 24*a* and 24*b* and through rear guide slot 27 to the exterior of the shell and back through front guide slot 28 to the interior of the shell where this front end of the strap is fastened to a buckle 31. The other strap member 30 is similarly fastened by fastener means 32 at a position at the left side of the shell corresponding to the position of fastener means 31. This strap member 30 is carried across the space between the rear peripheral edges 24*a* and 24*b* to the right side of the shell where it passes through rear guide slot 25 to the exterior of the shell and then back through front guide slot 26 to the interior of the shell. If a third slot is utilized the strap will face on the outside of the helmet. The free end 30*a* of strap member 30 is longer than the free end of strap member 29 so that strap end 30*a* can be passed under the chin of the wearer and looped through the buckle 31. A fastening means is provided for holding strap member 30 secure to strap member 29 after passing it through buckle 31. This holding means may comprise strips of material fastened to one side of strap end 30*a* and spaced somewhat from each other. This space between the material strips is positioned to be located at the buckle 31 when the strap is tightened beneath the chin of the wearer. Then by folding the strap end 20*a* back on itself the said strips of material may be made to overlie each other. The material or materials of these strips are such that they will cling to each other. The said strips of material are not seen in FIG. 1 or any of the other figures, as they are covered by the strap end 30*a* in FIG. 1. The arrangement of the straps in relation to the helmet and the wearer is similar to that shown for the straps in co-pending application Ser. No. 612,905, filed Sept. 12, 1975. It will be understood that some other form of fastening means may be used if desired.

At the nape area the strap members 29 and 30 cross each other as seen in FIG. 5 and at this area a nape pad 34 of a suitable soft material is attached to both straps in a suitable manner. At the position where strap end 30*a* passes beneath the wearer's chin there is provided a pad 36 which may be made to adhere to this strap end by a suitable adhesive or by other desired means of attachment. When the helmet is put on the head of the wearer the pad 34 is applied at the nape of the wearer's neck. The chin strap end 30*a* is carried under the chin so that the pad 36 is in contact with the under side of the chin and this strap is then looped through the buckle 31 and fastened by the fasteners as described above. In pulling the strap members 29 and 30 together with mild tightness in this manner, the nape pad 34 is in mild pressure contact with the nape of the wearer and the chin pad 36 is likewise in mild contact with the underside of the wearer's chin. Thus, the crossed strap portions at the nape acts as a nape strap and the portion under the chin acts as a chin strap, forming a closed loop of minimum circumference. This secures the helmet to the head and prevents it from coming off in the event of an ejection. It is recognized that when the strap members are drawn together to the proper degree of tightness at the chin, they are also at the proper degree of tightness at the nape, owing to the slidability of the strap members at the strap guides. The general arrangement of the straps in their guides is similar to that shown in said prior application Ser. No. 612,905.

The helmet illustrated in FIGS. 1 through 14 hereof is provided with features in addition to those shown in application Ser. No. 612,905, as will be described presently.

Referring to FIGS. 1 and 3*a*, the upper and forehead part of the visor housing 18 is provided with a number of raised louvers which extend laterally relative to the head of the wearer and have a curvature causing them to act as "spoilers" relative to air passing by the helmet during an ejection. The forward wall 37 of each row of these louvers slants rearwardly and upwardly from the main contour of shield 18 as best seen in FIGS. 3 and 4. The rear wall 38 of each louver is re-entrant back to the general level of the contoured surface so that each pair of adjacent walls 37 and 38 forms a ridge 40. Each forward louver wall 37 is provided with a laterally extending opening 39 for egress of air entering the region between the helmet shell 11 and the visor housing 18. The louver ridges are discontinuous in their lateral extent. Thus, the region along the fore and aft center line 41 (FIGS. 1 and 2) is devoid of louver structure. Also there is a discontinuity of louver structure at the regions marked by broken lines 42 and 43 in FIG. 1.

An optical alternative to the louver construction shown in FIGS. 1 and 3*a* is shown in FIG. 3*b* wherein the rear walls 38 of FIGS. 3*a* are replaced by rear walls 38*b* which are provided with a jog 38*c*. Also the openings 39 appearing in the forward walls 37 of FIG. 3*a* are eliminated in FIG. 3*b* where they are replaced by openings 39*b*. It is seen that the openings 38*d* face in substantially the same direction as the openings 39 of FIG. 3*a*.

FIG. 3*c* illustrates still another modification from the structure shown in FIGS. 1 and 3*a*. In FIG. 3*c* the ridges are the same as those illustrated in FIGS. 1 and 2 and 3*a*, except that no louver openings such as openings 39 and 39*b* are present.

The space existing between the rounded rear edge 46 of the visor housing and the dome of shell 11 is normally closed by a closure 47, seen in FIGS. 2 and 4. It comprises a curved ring extending over the crown of the shell and down each side to a position almost at the lower side periphery 45*a* of the visor housing. The rear edge 47*a* lies flat against the shell with which its curvature conforms. From the rear edge 47*a* the closure flares outwardly to engage the rear rim 46 of the visor housing along the forward edge 47*b* of the closure. For the purpose of engaging the forward edge 47*b* with the rear edge of the visor housing, the edge 47*b* is provided with an outstanding lip 90 and the rear edge 46 of the visor housing is provided with a depending lip 91 such that lip 90 can be retained in front of lip 91 as seen in FIG. 4. The lower end of each side of the closure 47 is provided with an offset 92 which extends forwardly within the visor housing. The offset at each side is provided with an outwardly extending pin 93 which protrudes through a slot 94 through the visor housing. The slot slants downwardly and rearwardly so that the closure may be disengaged from its position at the visor housing shown in FIG. 4. For this purpose a tab 94*a* is attached to the upper part of the closure. The disengagement of the closure from its position shown in FIG. 4 may be accomplished by manually pushing downwardly on the tab so that the pins 93 slide downwardly and rearwardly through their slots thereby allowing the lip 90 of the closure to move inwardly and thus clear the lip 91 of the visor housing to open the closure which will pivot at the pins 93. The resilience of the closure material facilitates this operation. A reason for this provision of an openable closure is to facilitate the removal or changing of the visor as may be desired, by the aircrew member, without the use of tools.

For the purpose of actuating and locking the visor, the visor housing is provided with a slot 50 along the center line 41. This slot commences at a position near the brow line of the housing, and extends rearwardly to a position near the upper rear end of the housing, the length of this slot being equal to the distance of movement of the visor in moving from a completely open position to a completely closed position where it is covering the face and eyes of the wearer by the maximum amount.

A visor lock 51 extends through this slot and attaches to the rear end of visor 22 such that the visor may be operated manually to slide the visor and to lock it into any desired position, which will ordinarily be either the position of maximum retraction or of maximum advance down in front of the eyes. Details of the visor lock are best seen in FIGS. 6, 7, 8, 9 and 10. It comprises a body 52 having through it an opening 52*a* through which there extends a screw 53 having a head 54 and threads 55 which thread into a nut having a cylindrical shank 56 dimensioned to fit into a cylindrical recess 57 of the body 52, which is an enlargement of, and coaxial with, hole 52*a*. The upper portion 52*b* of body 52 is cylindrical, below which there is a section 52*c* of square cross section. The lower end of the body enlarges laterally forming a wing 83. The lower end of the nut shank 56 is provided with a rectangular flange portion 56*a*. The visor lock is provided with a housing 58 which is rectangular as seen from above. It contains a top wall 59, preferably covered by a cap 59*a* of a soft or resilient material to avoid damaging knocks against an aircraft cabin wall or the like, through which there is a circular hole 60, and a pair of opposite lateral sides 61 and 62, and a bottom wall 63 having a rectangular hole 64 axially aligned with hole 60. The fore and aft walls 62*a* and 61*a* are each provided with a rectangular opening 62*b* and 61*b*, respectively. Within the lock housing there is provided a rectangular block 66 having through it a circular hole 67 which fits over the outer circumference 52*b* of the portion of bushing 52 immediately beneath the screw head 54. The inner portion of block 66 rests on the shoulder 69 of body section 52*c* and is held between this shoulder and the screw head.

The visor lock is provided with a pair of actuators 70 and 71, similar to each other, located on opposite sides of body 52 in the fore and aft direction of movement of the visor lock through the slot 50. These actuators are within the lateral walls 61 and 62 of the visor lock housing but protrude from the respective rectangular openings 62*b* and 61*b* of the lock housing in the fore and aft direction, as seen in FIGS. 6 and 9. Actuator 71 has side walls 71*a* and 71*b* which slidably fit within walls 61 and 62 of the housing 58. Similarly actuator 70 has side walls 70*a* and 70*b* which slidably fit within walls 61 and 62. The upper wall 70*c* and lower wall 70*d* of actuator 71 slidably fit into top and bottom walls 59 and 63 respectively. The upper and lower walls of actuator 70 similarly fit slidably within the upper and lower walls of the lock housing. The side walls of the actuators also have a sliding fit over the side walls of block 66. The upper walls of the actuators are provided with arcuate surfaces 70*e* for clearance from the screw head 54. Each of a pair of pins 72, 73 is fixed to, and extends laterally through, block 66 at opposite sides of body 52, in the fore and aft direction, and protrudes laterally beyond opposite sides of the block. These laterally protruding ends of pin 73 extend into respective slots 74 and 75 through the opposite side walls 71*a* and 71*b* of actuator 71. Actuator 70 has a similar pair of slots 74 and 75 similarly located which receive the ends of pin 72. Each of these slots is elongated with its longer axis slanted upwardly from the horizontal toward the screw 53. The diameters of the pins relative to the widths of the slots are such that the pins making sliding contact within the slot walls. Thus the actuators 70 and 71 are slidable through the lock housing 58 in the fore and aft direction toward and away from each other. Compression springs 76 and 77 are provided for urging the actuators 70 and 71 to slide away from each other. For this purpose each actuator is provided with a pair of bores 78 and 79 into which the ends of the compression springs are fitted.

For attachment of the visor lock to the visor, the visor is provided with a circular hole 80 near its rear edge **22*b* as best seen in FIG. 8. This hole opens to the rear edge 22*b* of the visor through a slot 81 which is relatively narrow compared to the diameter of the hole 80. The portion of the nut just above the lower flange 56*a* is provided with a wing 82 of a length permitting its extremities to fit closely within the circumference of circular hole 80. Thus by turning the nut 90° relative to the position indicated in FIG. 8 the wing may pass through slot 81 into hole 80 and then turn 90° to the position shown in FIG. 8 where the nut fastens to the visor by turning screw 53. The body 52 is provided with a wing 83 extending laterally in both directions at a position on the upper side of the visor so that when the nut 53 is tightened the visor is clamped between wings 56*a* and 83. The dimension of square section 52*c* is such that it will slide through slot 50** but will not rotate within the slot.

By reason of the compressive force of springs 76 and 77 urging the actuators 70 and 71 to slide apart from each other the slots of the two actuators move apart to the same extent. This produces a lifting action on the pins which correspondingly exerts a lifting force on block 66, screw 53, nut 56 and body 52 with its flange 83, relative to the bottom of the lock housing. Hence the part of the visor housing 18 on both sides of the slot 50 are squeezed between the flange 83 and the bottom of the lock housing so that the visor will remain in a locked condition. When it is desired to move the visor, the actuators 70 and 71 are manually squeezed together, for example between the thumb and forefinger, against the force of the springs so that the action of actuator slots against the pins 72 and 73 causes the body 52 to tend to move downward to release the pressure of flange 83 from the under side of the visor housing so that the visor lock can easily be moved forwardly or rearwardly through the slot 50 to change the position of the visor.

It is seen that the visor lock is assembled by putting its component parts in their places and torquing the screw 53 to pull the nut 56 up into hole 57 of the body 52. This is done before inserting the pins 72 and 73 in their places. Then the pins are put into the assembly by inserting them through the respective slots of the actuator and through the holes of block 66. The fit of the pins through block 66 is a force fit which effectively fixes them to the block.

The visor slides on a pair of tracks which are formed in the spacing elements 20 at each side of the helmet between the shell and visor housing. This spacer-track 20 is indicated in dotted lines at its position beneath the visor housing in FIG. 4, at the left side of the helmet. FIGS. 11 and 12 show details of the track. The detail of FIG. 11 is taken from line 11—11 of FIG. 4 and it also appears at line 11—11 of FIG. 12.

It is seen that the track-spacer member 20 has a surface 96 flush with the inside surface of the visor housing 18 and an opposite surface flush with the outer surface of the helmet shell 11. A lip 98 extends outwardly toward visor housing 18 for a distance, and below the lip there is formed the side surface 99 of the visor track. Surface 99 meets the bottom surface 100 of the track which extends between surface 99 and the surface 96. A visor strip 101 is provided to receive the bottom side edge 102 of the visor, which fits into a slot 103 formed along the length of strip 101. The visor is attached to this strip as by adhesive. The visor 101 has a curvature conforming with that of the track which is curved to conform with the direction of movement of the visor. When the visor is pulled down over the eyes from a retracted position, the track 101 slides with the visor through the elongated curved passage formed by elements 98, 99 and 100 of member 20. To facilitate the sliding of the visor strip 101 there may be provided a wire-like member 104 bent at each end so as to protrude into the bottom side of the visor strip causing it to ride easily on track surface 100.

It is a common practice to use with the helmet a face mask for supplying oxygen. Such a face mask is commonly attached to the helmet by means of bayonets at the sides which enter into bayonet receivers at the respective sides of the helmet. The forward ends of such bayonet receivers 110 and 111 are seen in FIG. 1 located between each depending sideburn of the visor housing and the exterior of the helmet shell. The side of bayonet receiver 111 is shown in FIG. 13 and is also shown in broken lines in FIG. 4 which show its position behind the lower part of sideburn 44. FIG. 14 shows a front view of this bayonet receiver looking from line 14—14 of FIG. 4. FIG. 15 shows the relation of one of the bayonet receivers to one of the bayonets. Each bayonet receiver comprises a pair of discs 112 and 113 held apart from each other by spacers 114 and 115 opposite each other at the periphery where the discs are shaped to have a lesser spacing from each other than at the center. The spacers have juxtaposed parallel surfaces 116 and 117 provided with juxtaposed teeth **116*a* and 117*a***, located at opposite sides of the center of the disc, and are attached to the discs.

The disc 112 is rotatably pivoted by a pivot pin 118 to the shell 11, this pivot pin passing also through a backing strip 119 inside the shell 11. A pair of slots 120 and 121 of equal size and shape are formed through the shell and the backing sheet 119 at opposite sides of the pivot pin 118, the center of curvature of these arcs being at the pivot pin. Screws 122 and 123 pass through these respective slots and thread into the respective spacers 114 and 115 at a position diametrically opposite each other. The arrangement is such that when the screws are threaded relatively loosely into their respective spacers the discs can be rotated on the pivot within the limits permitted by the lengths of the arcuate slots, both of which are of the same length. When the two screws are torqued, the peripheral parts of the disc are pulled toward the shell to bind the inner part of disc 112 against the shell so that the discs will not turn relative to the slots after the screws are sufficiently torqued. It is seen that when the screws are tightened while centrally located within their slots as shown in FIG. 13, the central axis of the channel 124 between the discs can be made substantially horizontal as indicated by line 125 (FIG. 13). When the discs are rotated to the maximum extent in one direction the axis of the channel turns to the position indicated by line 126, and when turned the maximum amount in the opposite direction the axis turns to the position indicated by line 127.

A common form of bayonet for a face mask comprises a prong member 133 protruding from a base portion 134 attached to the mask (not shown). A pair of dogs 135 are pivoted at 136 to the prong, the forward end of each dog being provided with a tooth 137. A spring 138 tends to hold the teeth apart from each other. When the prong is inserted into the bayonet receiver, the curvature at the forward edges of the teeth 137 causes them to cam on the respective teeth 116*a* and 116*b* of the receiver, allowing the teeth 137 to enter the base portions of teeth 116*a* and 117*a* at a desired position along the extent of teeth 116*a* and 117*a*. When it is desired to withdraw the bayonet from the receiver, the teeth 137 are forced toward each other against the force of spring 138 by a mechanism which moves levers 139 along dogs 135 to do this. The mask and bayonets are known devices and no part of the present invention.

According to a desirable but optional feature, for the purpose of indicating the position of the axis of this channel, an arrow 128 is marked on the outer surface of the outer disc 113 and lines 129 representing a scale of degrees of the arc through which the disc may turn are marked on the outer surface of the shell just outside the periphery of the discs. Thus, the arrow 128 is shown in FIG. 13 pointing to the central line of the scale to indicate that the channel 124 extends horizontally on axis 125. If the disc be turned to a position in which the channel axis is other than horizontal the angularity will be indicated by the arrow on the scale. Where this type of indicator and scale are used it will be desirable to provide a window of transparent material through, and flush with, the sideburns at the locations of the arrow and scale, within the area enclosed by the broken line enclosure 140 in FIG. 4.

The advantage of these adjustable bayonet receivers with their indicators of angularity resides in the fact that the best angle of the bayonet receivers for proper placement of the mask varies from person to person. Accordingly, when a helmet is assigned to a particular person, he may make the correct angular adjustment by loosening screws 122, 123 and then inserting the bayonets of his face mask into the bayonet receivers of his helmet while wearing the helmet in its proper position. The face mask will then be properly adjusted which may be done since the screws 122 and 123 are now loose, thus allowing the discs to be turned to the proper position. When this proper position is found, the helmet will be removed from the wearer's head while maintaining the face mask in this same position, and the screws 122 and 123 will then be tightened to maintain this position. The advantage of the window 140 is that the wearer may read the angular position through the window. It will be well for the wearer to make a note of the correct angular position, because subsequent use of the helmet and mask by some other person would likely involve a different adjustment of the face mask. Then when the first-mentioned wearer is about to wear the helmet again, he may readily adjust the angularity to the original angular reading by loosening the screws 122 and 123 and then tightening them again after the adjustment is made.

FIGS. 16 and 17 illustrate a visor housing on a helmet according to this invention. The helmet comprises a helmet shell 11 which is identical with the shell 11 of FIGS. 1, 2, 4 and 5. Only part of the helmet shell is shown in FIG. 16. The helmet is provided with a visor housing 145 which fits over the shell in the same manner as does the visor housing 18 of FIG. 1 and it occupies the same position over the shell as does the visor housing 18 of FIG. 1. The visor housing 145 is spaced from the shell in the same manner and by the same amount as in FIGS. 1, 2 and 4 and it contains a slot 146 through it similarly positioned and dimensioned as the slot 50 of FIG. 1. There is positioned a visor similar to that of FIG. 1 (not shown in FIGS. 16 and 17) in the space between the visor housing and the shell, and movable on tracks structured the same as illustrated in FIG. 4. The visor is operated from handle 147 which attaches to the visor and functions as a visor lock, its structure being the same as the visor lock 51 shown in FIGS. 1, 2 and 4. The visor housing has downwardly extensions or sideburns 148 positioned and dimensioned similar to the sideburns 44 shown in FIGS. 1 and 4, and contoured to merge at positions 155 into flat areas 13 of the shell in the same manner as areas 45 merge into flat areas 13 as seen in FIG. 4. The visor housing 145 attaches to the shell by fasteners 156 in the same manner as the visor housing of FIGS. 1 and 4 is fastened by fasteners 21. The space between the rear edge of the visor housing and the shell is normally closed by a closure 149 constructed and arranged the same as closure 47 shown in FIGS. 2 and 4. It is openable by a pivot and slot arrangement similar to those shown in FIG. 4. The helmet includes bayonet receivers (not shown in FIGS. 16 and 17) for the bayonets of a face mask constructed and positioned as shown in FIGS. 4, 13 and 14.

A unique feature of the visor housing in FIGS. 16 and 17 resides in the provision of an anti-lift device 150 at the upper surface of the visor housing. This anti-lift device is in the form of a flange 150 outstanding from the visor housing. This flange extends from a forward edge of the visor housing at the forehead area of the wearer and passes completely around the top crown area and back to the forward edge at the opposite side of the visor housing at the wearer's forehead. This flange is a ring-like member, although the ring is not a closed ring since it does not pass across the forehead. The flange rises from a lowest elevation at or near its forward ends to a highest elevation at the top crown area, preferably just back of the peak of the helmet. At its forward ends this flange slants outwardly and somewhat upward from the horizontal and gradually becomes more vertical toward the rear crown area. The width of the flange increases gradually from a minimum width at the forward edges of the visor to a maximum width at the rear crown area, where it would be intersected by the slot 146 if the slot had extended as far rearward as the flange. Also, its upward flare becomes more vertical toward the rear crown area until it becomes close to the vertical at this central position of the flange which would be intersected by the slot 146 if the slot were continued rearward as far as the flange. The broken line 157 in FIGS. 16 and 17 indicates the vertical when worn by a wearer. As seen in FIGS. 16 and 17 the flange has two opposite surfaces one of which is a forwardly facing surface which receives the wind blast during ejection, and the other of which faces away from the wind blast.

The flange 150 is of a material which is rigid, at least when pressurized toward the rear by air impinging on it from the front. It may optionally be constructed of a material such that although it does not deform from pressure from the front, it may be collapsed downwardly against or toward the surface of the visor housing. Collapsability in this manner may be a desirable feature when used in an aircraft cabin where ceiling height is limited. Thus if a helmet being worn strikes the ceiling, it may be desirable for the flange to do some collapsing until it is free from contact with the ceiling, after which is should return to its original normal shape.

In the interest of lightness of weight, the helmet shell should be made of a relatively lightweight material having low-weight high-strength ratio properties, such as a reinforced epoxy resin. The visor housing should likewise be of a lightweight high strength material. In view of the relatively small side-to-side dimension of the helmet, it is preferable to eliminate earphones from the sides and instead to supply ear cups of an elastomeric material of shallow lateral dimension to which acoustical tubes are brought from a transducer located within the rear of the shell at the nape of the neck.

From the foregoing description and illustration of the features of the helmet it is seen that there is provided a helmet of relatively light weight, relatively low profile and relatively small bulk which is comfortable to wear and is free from obstacles to movement of the person.

The visor housing is unique in its feature of the ring-like flange 150, which may conveniently be referred to as a anti-lift loop. The anti-lift action of the anti-lift loop is achieved by a three-fold action. First, the leading edges from positions 150*a* at each side to somewhat more rearward positions 150*b* at each side act as wings at a negative angle of attack during wind blast conditions, thus producing negative lift. Secondly, the upper portions between positions 150*b* and the rear central position 150*c* acts as a conventional airplane wing type spoiler. This is due to air thrown upwardly at these rearward regions as indicated by arrow 151 in FIG. 16 meeting the wind represented by arrow 152 coming over the top of the visor housing and creating a turbulence indicated by arrow 153 above the visor housing which disrupts the skin effect at the top of the visor housing which would otherwise occur. Thirdly, the unique blending together of the two separate actions, namely the negative lift due to the leading edges and the spoiler effect due to the rearward part of the flange, each enhance the effect of the other, that is, result in a synergistic effect, assuring boundary layer separation at the peak of the visor housing device due to diverted or scooped air adding momentum to the top flow of air.

The linear distance from positions 150*a* to 150*b* is preferably in the order of about one third of the linear distance from positions 150*a* and 150*c*. This relationship is not critical however, and there can be some variation from it.

It will be understood that the embodiment of the invention illustrated and described herein is given by way of illustration and not of limitation, and that modifications or equivalents or alternatives within the scope of the invention may suggest themselves to those skilled in the art.

I claim:

1. In a helmet adapted for use in aircraft and during ejection therefrom, said helmet being of the type having a shell which covers the wearer's head, a visor housing spaced from, and covering, an upper part of the shell, a visor retractable within the space between the shell and the visor housing and strap means for securing the helmet to the head of a wearer:

an anti-lift device attached at the upper surface of said visor housing, said anti-lift device comprising a flange outstanding from the visor housing and extending from a position near a forward side edge of the visor housing at the forehead area of the wearer and passing around the top crown area to a position near the forward side edge of the visor housing at the opposite side of the wearer's forehead said flange rising from a lowest elevation near said forward side edges to a highest elevation at the top crown area and having two opposite surfaces a first of which faces and receives wind blast during ejection and the second of which faces away from the wind blast, the regions at and adjacent said forward side edges constituting wings positioned at a negative angle of attack against the wind blast, thus producing negative lift, and the region at and adjacent the top crown area constituting a spoiler producing turbulence which disrupts skin effect at the region of the top crown area, thus spoiling upward lift.

2. Apparatus according to claim 1 in which said flange extends outwardly from the sides of the visor housing with an upward slant to provide wings with a negative angle of attack at the leading edge regions and becoming substantially vertical at the top crown area where it forms the spoiler.

3. Equipment according to claim 1 in which the width of the flange increases from a minimum width at its forward lowermost regions to a maximum width at the uppermost region.

4. Equipment according to claim 1 in which the first of said surfaces faces upwardly at the regions at and adjacent said forward side edges and the second of said surfaces faces downwardly at the regions at and adjacent said forward side edges.

* * * * *